US006021796A

United States Patent [19]

Vavra

[11] Patent Number: 6,021,796

[45] Date of Patent: Feb. 8, 2000

[54] TETRA TENT

[75] Inventor: David A. Vavra, Denver, Colo.

[73] Assignee: T.A. Pelsue Company, Englewood, Colo.

[21] Appl. No.: 09/158,649

[22] Filed: Sep. 22, 1998

Related U.S. Application Data

[60] Provisional application No. 60/059,518, Sep. 22, 1997.

[51] Int. Cl.[7] ..... E04H 15/16; E04H 15/34; E04H 15/48

[52] U.S. Cl. ..... 135/147; 135/94; 135/121

[58] Field of Search ..... 135/93, 94, 100, 135/120.3, 121, 125, 126, 128, 135, 136, 143, 147

[56] References Cited

U.S. PATENT DOCUMENTS

| | | | |
|---|---|---|---|
| 3,269,398 | 8/1966 | Holbitz | 135/125 X |
| 3,625,235 | 12/1971 | Gorgichuk | 135/125 X |
| 3,810,482 | 5/1974 | Beavers | 135/147 |
| 3,896,830 | 7/1975 | Sharick | 135/93 |
| 3,941,140 | 3/1976 | Beavers | 135/147 |
| 3,968,809 | 7/1976 | Beavers | 135/120.3 X |
| 4,077,417 | 3/1978 | Beavers | 135/121 |
| 4,285,354 | 8/1981 | Beavers | 135/135 |
| 4,809,726 | 3/1989 | Gillis | 135/136 |
| 4,941,499 | 7/1990 | Pelsue et al. | 135/125 |
| 5,036,874 | 8/1991 | Lynch | 135/99 |
| 5,361,794 | 11/1994 | Brady | 135/147 |
| 5,365,961 | 11/1994 | Bamber et al. | 135/94 X |
| 5,628,338 | 5/1997 | Stumbo | 135/147 |

FOREIGN PATENT DOCUMENTS

| | | | |
|---|---|---|---|
| 28986 | 3/1979 | Australia | 135/147 |
| 721247 | 3/1932 | France | 135/147 |
| 1159434 | 6/1958 | France | 135/100 |
| 2349383 | 5/1974 | Germany | 135/147 |
| 541040 | 11/1941 | United Kingdom | 135/147 |

*Primary Examiner*—Laura A. Callo
*Attorney, Agent, or Firm*—Dorsey & Whitney LLP

[57] ABSTRACT

A lightweight, spacious and collapsible tent having an apex and contacting the ground on three struts, utilizing: three collapsible subframes each containg four struts pivotally connected at one end to a central hub and extending radially outward to a distal end; a flexible covering having four sides and corners, said covering overlaying the hub and struts and extending so that each corner extends to the distal end of a strut; each of said subframes being connected along two sides to one of the sides of each of the other two subframes; each of said subframes having a strut the distal end of which is pivotally connected to the distal end of a strut from each of the other two subframes to form the apex of the tent; and each of said subframes resting on the ground on the distal end of a strut farthest from the apex.

17 Claims, 4 Drawing Sheets

TETRA TENT

CROSS-REFERENCE TO RELATED APPLICATION

This application is related to U.S. application Ser. No. 60/059,518 filed Sep. 22, 1997.

TECHNICAL FIELD OF THE INVENTION

The invention relates to an improved tent useful for recreational and other purposes. The tent is unitary, free-standing and collapsible making it extremely easy to put up, take down and transport. The use of three collapsible sub-frames in the tent of the present invention makes the tent very stable in windy conditions and under other surface loads, such as snow. It also maximizes the floor space and internal volume of the tent and provides improved ventilation.

BACKGROUND OF THE INVENTION

A recreational tent should have a number of desirable features. For example, it is highly desirable that the tent be as lightweight and portable as possible. It should be easy to put up and take down. The tent should have a minimum number of separate pieces. Once installed, the tent should provide a maximum amount of floor space as well as internal volume. It is desirable for many users that the tent have an attached floor. The tent should provide easy ingress and egress and thorough ventilation, yet should provide adequate shelter from the weather. The tent should also be stable in all weather conditions including wind and should be able to adequately support any surface loads such as rain and snow. Although many tents designs have been proposed in the prior art, no tent has adequately maximized all of these desirable features.

Collapsible tents particularly suited for industrial use have been described in U.S. Pat. Nos. 3,810,482 and 3,968,809. These tents are generally not suited for recreational use because of their high profiles, square footprints and generally flat roofs. The first of these patents teaches that a minimum of four subframe assemblies is required. The latter teaches that a three subframe assembly is unstable unless attached to another structure, in that instance the "rear end" of a van. The number of frames required increases the weight of the tent and decreases its portability.

Efforts have been made to utilize similar subframe systems to produce recreational tents, as shown, for example, in U.S. Pat. Nos. 3,941,140, 4,077,417 and 4,941,499. Because these tents use square subframes, it has been necessary to have a tent with an unduly high profile to have a length adequate to cover a sleeping adult. The problem cannot be readily solved by using rectangular subframes, since the use of struts of different lengths in the same subframe results in torsion that causes twisting of the struts and subframes and the tent in which they are incorporated. The use of four square subframes as shown in U.S. Pat. No. 4,941,499 produces a tent of undue complexity and weight. Also, it is impossible to provide such a tent which can be erected and collapsed with an attached floor. Although the tents shown in these patents are useful as industrial "trench" tents, they are not practical for recreational purposes.

The present invention solves these problems and optimizes the features desired in a recreational tent both individually and collectively.

SUMMARY OF THE INVENTION

The present invention is a unitary, lightweight, spacious and collapsible tent. The tent comprises three connected sub-frames each of said sub-frames containing four struts. Each of the struts in a subframe is pivotally connected at one end to a central hub and extends radially outward to a distal end. In addition, each subframe includes a flexible covering having four sides and four corners, said covering overlaying the hub and struts and extending so that each corner is attached to the distal end of a strut. Each subframe is connected along two of its sides to one of the sides of each of the other two subframes. Finally, the distal end of one strut in each of the three subframes is pivotally connected to the distal end of a strut from each of the other two subframes to form an apex of the tent. The tent is supported on the ground by the distal end of a strut in each subframe, which end is furthest away from the apex.

The stability of the tent is achieved with only three subframes by orienting each subframe so that two of the struts are arranged 180° from one another about the hub in a vertical line or arc and arranging the subframes so that each one is joined to each of the other subframes along their common sides. The other two struts in each frame are also arranged 180° from one another about the hub in a generally horizontal line. Forces asserted against the tent are generally transmitted by the struts in a manner for maximum resistance or dissipation. In particular, forces such as those generated by rain or snow, transmitted downwardly on the tent are transferred by the combination of vertically linear struts in each subframe assembly directly to the ground. With this arrangement all structural components, i.e., struts, hubs and flexible covering are connected to one another in a single package. Nevertheless, despite these interconnections, the tent can be erected and collapsed in a remarkably short amount of time by a single person in almost any weather conditions.

BRIEF DESCRIPTION OF THE DRAWINGS

For convenience, the drawings are briefly described as follows.

A more complete understanding of the present invention may be derived by referring to the detailed description and claims which follow when considered in connection with the accompanying drawings.

DETAILED DESCRIPTION OF THE INVENTION AND THE PREFERRED EMBODIMENT

The following detailed description is provided in reference to the accompanying FIGS. 1 through 10, wherein like reference numbers indicate like features throughout the drawings. To avoid redundancy, to simplify the presentations and to focus each drawing on the key features therein, not all items are referenced on every drawing.

Figure 1:
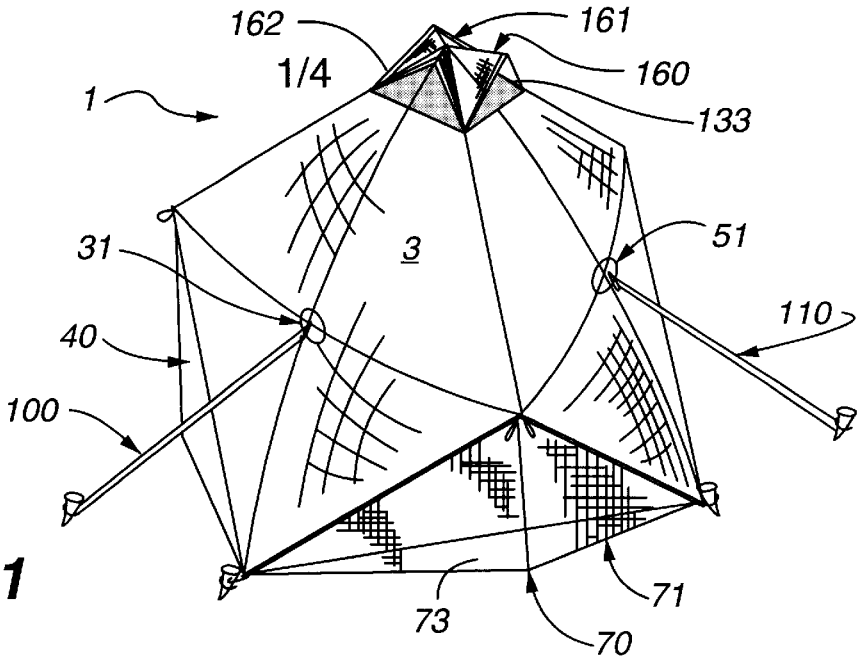
FIG. 1 is an isometric view of a preferred embodiment of the tent of the present invention. The dotted lines show where the flexible tent covering folds over the subframes which are located underneath that covering. Similarly, dotted lines are used on the other external views of the tent shown in FIGS. 2, 3, 5, 8 and 9.
Figure 2:
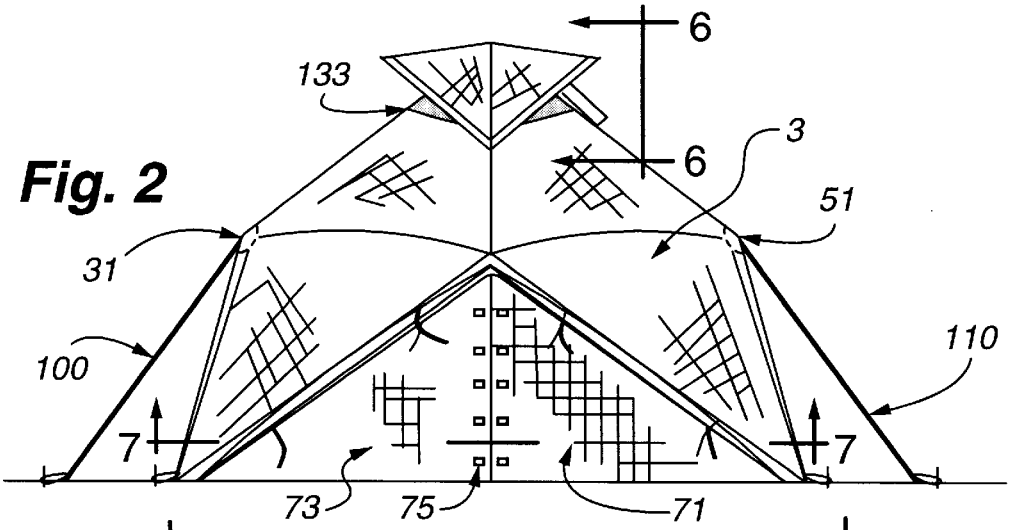
FIG. 2 is a horizontal view of one embodiment of the tent. A door of the tent is shown in the foreground.
Figure 3:
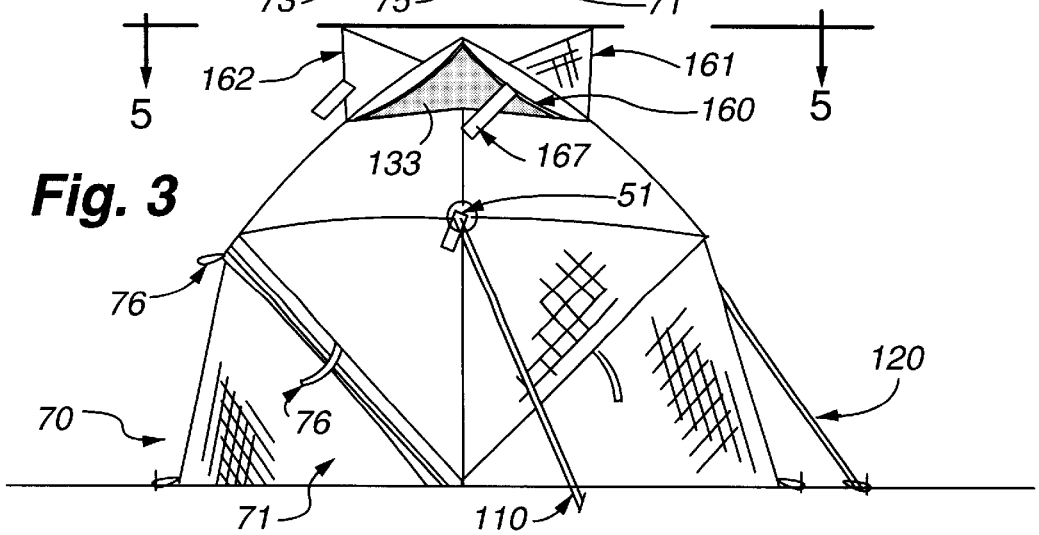
FIG. 3 is a horizontal view of the tent shown in FIG. 1 taken from a position in which the tent is rotated 90° in a clockwise direction from its position in FIG. 2.
Figure 4:
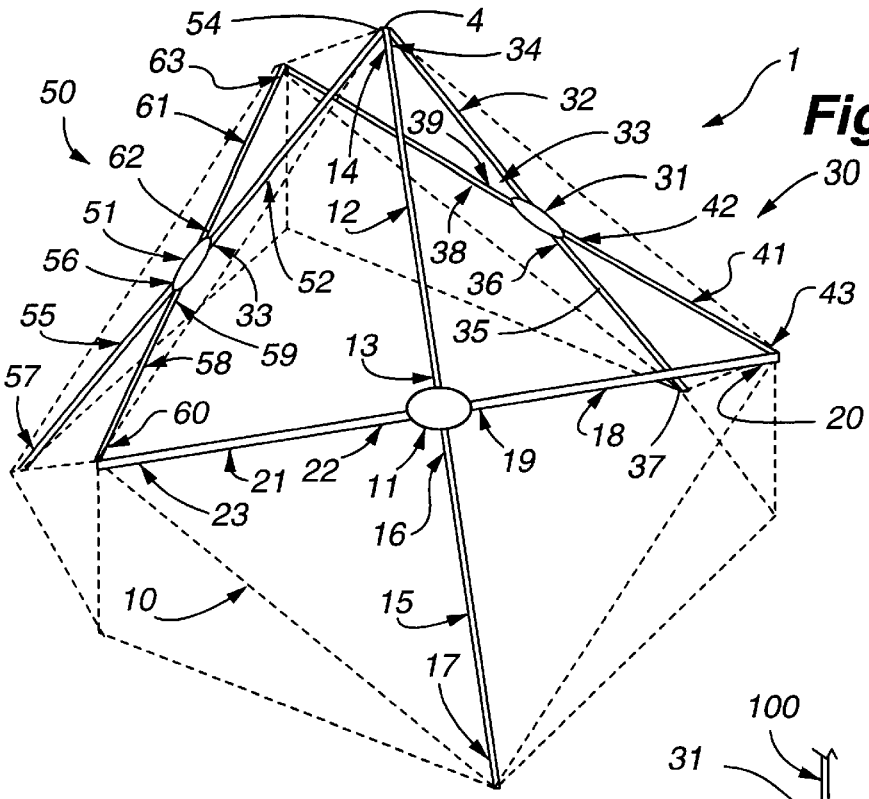
FIG. 4 is an isometric view of the tent in erected position with the flexible covering removed to show the three subframe assemblies. The dashed lines show the outlines where the covering would normally be.
Figure 5:
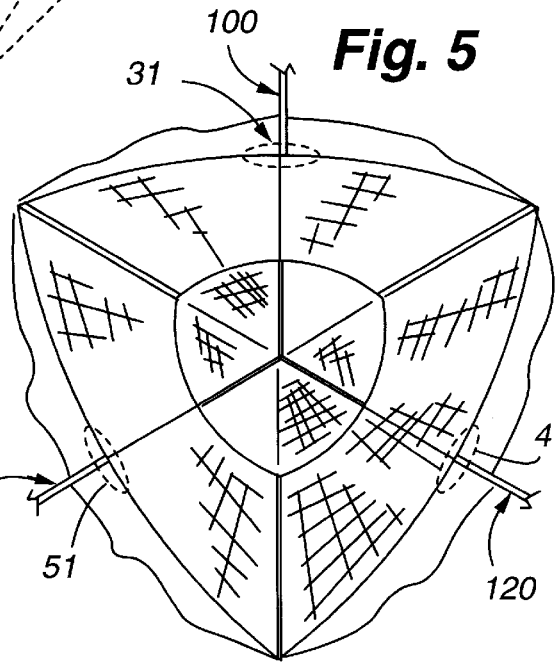
FIG. 5 is a top view of the tent including the apex and one form of vent that could be used at the apex.

FIGS. 1 through 4 show the basic configuration of the tent 1 in a preferred embodiment of the present invention. The tent is shown in the fully erected condition. FIGS. 1 through 3 show exterior views of the tent, with dotted lines showing where the flexible covering folds slightly over the struts and hubs comprising the subframes. In contrast, FIG. 4 depicts the three subframe assemblies of the tent. For ease of illustration, the covering is not shown, but its outer edges or folds are indicated by dashed lines.

Each of the identical subframes 10, 30 and 50 consists of the same basic elements. For example, subframe 10 closest to the foreground in FIG. 4 consists of a hub 11 to which four struts, 12, 15, 18 and 21 are attached at approximately 90° angles. As illustrated, the struts in a preferred embodiment of the present invention are of equal length. This facilitates construction of the tent. More importantly, it greatly simplifies the dynamics of operation, since the stresses placed on the subframe are generally similar, therefore diminishing the tendency of the struts to twist where different lengths are used for struts in the horizontal and vertical direction. Nevertheless, it is possible to use subframes with struts of different lengths in certain configurations.

In subframe 10 just referred to, struts 12 and 15 extend in a vertical direction and struts 18 and 21 extend in a generally horizontal direction when the tent is erected. Strut 12 comprises a lower end 13, which is attached to the hub, and strut 15 has an upper end 16 which is attached to the same hub at a point approximately 180° from end 13. The distal end 14 of strut 12 is pivotally attached to similar struts of the other two subframes at the apex 4 of the tent. Specifically, distal end 14 is pivotally attached to the distal end 34 of strut 32 in subframe 30 and to the distal end 54 of strut 52 in subframe 50. The distal or lower end 17 of the other horizontal strut 15 contacts the ground.

Horizontal strut 18 is attached to the hub at end 19, and horizontal strut 21 is attached to the hub at end 22 at a point on the hub approximately 180° from the point of attachment of end 19. The distal end 20 of strut 18 is pivotally attached to the distal end 43 of strut 41 in adjacent subframe 30. Similarly, the distal end 23 of strut 21 is pivotally attached to the distal end 60 of strut 59 in the other adjacent subframe 50.

In the embodiment shown in these figures, struts 18 and 21 lie in a generally horizontal line. However, in certain configurations of the tent, e.g., where a taller entrance is desired, this may not be true. In that instance, each of these struts may point slightly upwardly in a direction away from the hub. On the other hand, it is highly desirable that the vertical struts lie in a line or arc perpendicular to the ground when the tent is erected.

In like manner, subframe 30 comprises hub 31, vertical struts 32 and 35 and horizontal struts 38 and 41. Strut 32 is attached at one end 33 to hub 31 and at the other end 34 is pivotally connected at the apex 4 of the tent to distal ends 14 and 54 of vertical struts 12 and 52 in subframes 10 and 50, respectively. The other vertical strut 35 in subframe 30 is attached at one end 36 to hub 31 and at its distal end 37 contacts the ground. Horizontal strut 38 is attached at end 39 to hub 31 and at its other end 40 is pivotally attached to the distal end 63 of strut 61 in subframe 50. Similarly, horizontal strut 41 is attached at end 42 to hub 31 and at the distal end 43 is pivotally attached to the distal end 20 of strut 18 in subframe 10.

Finally, subframe 50 comprises hub 51, vertical struts 52 and 55 and horizontal struts 58 and 61. Strut 52 is attached at one end 53 to hub 51 and at the other end 54 is pivotally connected at the apex 4 of the tent to distal ends 14 and 34 of vertical struts 12 and 32 in subframes 10 and 30. The other vertical strut 55 in subframe 50 is attached at one end 56 to hub 51 and at its distal end 57 contacts the ground. Horizontal strut 58 is attached at one end 59 to hub 51 and at its other end 60 is pivotally attached to the distal end 23 of strut 21 in subframe 10. Similarly, horizontal strut 61 is attached at one end 62 to the hub 51 and at the distal end 63 is pivotally attached to the distal end 40 of strut 38 in subframe 30.

The struts and hubs of each subframe are made of a material or materials that are durable but lightweight. For example, the hubs may be made of aluminum or another lightweight metal or durable plastic. The struts may be aluminum or fiberglass. The struts should be relatively rigid, but flexible enough to cooperate with the flexible covering of the tent, as described below, to hold the subframes in the erected position. In a preferred embodiment, struts for a recreational size tent are made of ½ inch diameter, solid fiberglass.

Figure 10:
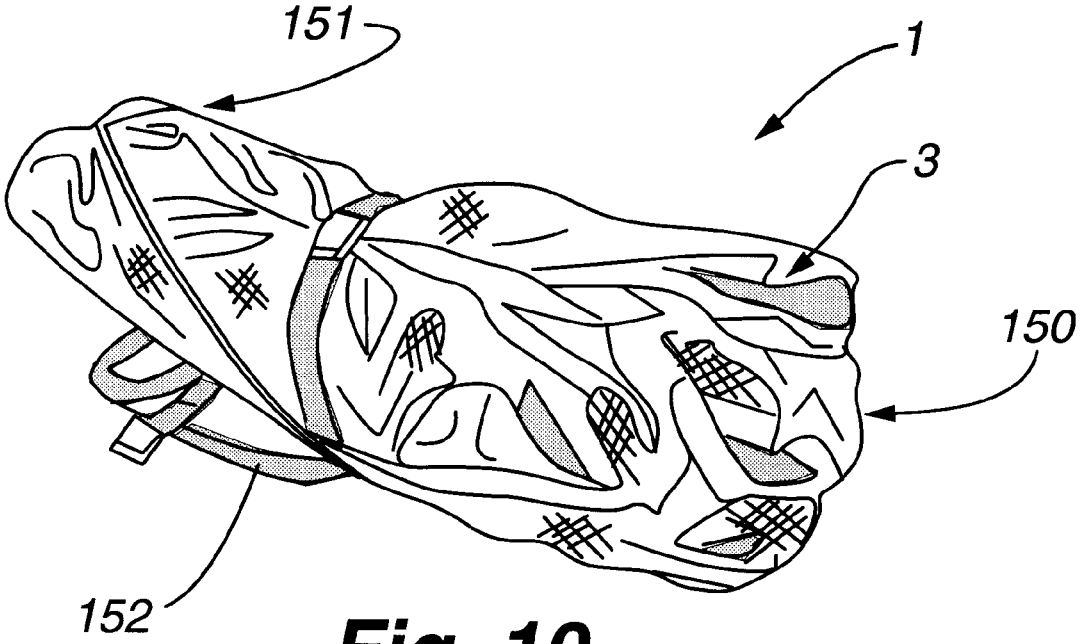
FIG. 10 is an isometric view of the tent in the collapsed and folded condition.

The hubs of the present invention may take various forms, such as those shown in U.S. Pat. Nos. 4,077,417 and 4,285,354, which are incorporated by reference herein. Preferably, each hub, such as 11, contains four sockets into which the ends 13, 16, 19 and 22 of the struts can be inserted so that they can rotate from a position as shown in FIGS. 1 and 4 in which the tent is in an erected condition to a position in which all four struts extend outwardly basically parallel to one another in the collapsed condition as shown in FIG. 10. In that position, the four ends 14, 17, 20 and 23 of the same struts lie next to one another. To permit this rotation, each of the ends 13, 16, 19 and 22 may contain a ball which sits within the appropriate socket on the hub. In essence, each strut can rotate in an arc of approximately 90° so that the struts of each subframe can (a) lie roughly in the same plane (at the point of attachment to the hub), although slightly bowed, in the erected condition, and (b) lie parallel to one another in the collapsed condition. The techniques by which this can be accomplished are generally known to one skilled in the art.

The three subframes 10, 30 and 50 are covered by a flexible covering 3 made of fabric or other flexible material. The material should be weather resistant. Also, it should be resiliently stretchable, at least in a diagonal direction, so that it will permit movement of the struts and will retain tension on them when the tent is in the erected condition. The material should recover to its original condition when the subframes are collapsed and the tension is removed rather than being permanently deformed. A preferred material is 250 denier oxford weave polyester with a urethane coating purchased, for example, from Travis Textiles.

For larger size tents, the structural requirements of the materials used for the hubs, struts and fabric also increase significantly.

Theoretically, a single piece of fabric may be used to cover all three subframes 10, 30 and 50. However, for ease of manufacture, a separate piece of fabric is preferably used for each subframe. The three subframes with the associated fabric are manufactured individually and are then constructed into a tent.

Figure 7:
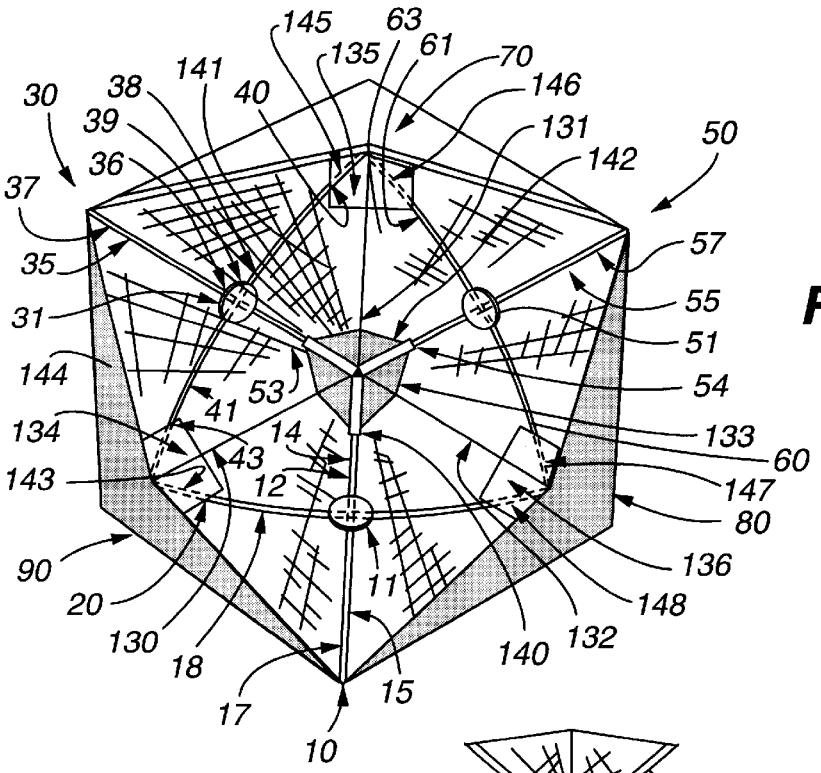
FIG. 7 is a view of the tent from the bottom. The shaded areas show portions of the tent between subframes which utilize a mesh material to provide ventilation.

The tent construction is best illustrated in the bottom view shown in FIG. 7. As constructed in that drawing, the flexible covering of the three subframes are sewn together via a hem along their common edges 130, 131 and 132. Subframes 10 and 30 share the common edge 130, subframes 30 and 50 share the common edge 131, and subframes 50 and 10 share the common edge 132. Thus each of the subframes is attached to the other two subframes by hemming the fabric on the flexible covering 3 on each of the common sides.

Figure 9:
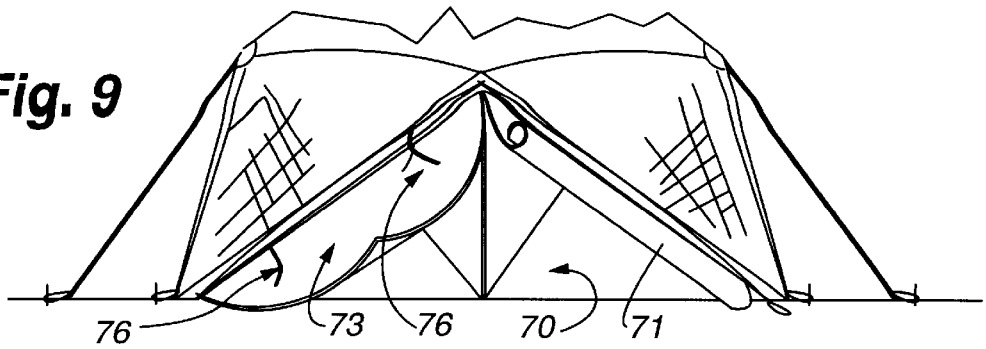
FIG. 9 is a detail view showing another form of covering that can be used at the opening between subframes.

FIG. 7 also illustrates the three openings between the square subframes that can be used in various ways to provide ventilation and ingress and egress to the tent as described later. In FIG. 7, areas 80 and 90 are covered by a mesh material to provide ventilation while screening out insects and wind-blown materials. Opening 70, has been finished with a flexible covering of the same material as tent covering 3 to form a door opening, further details of which are also depicted in FIG. 2, 3, and 9 as described below.

In addition, a portion of the flexible tent covering at the apex 4 of the tent has been replaced by flexible mesh material, 133, to facilitate ventilation. Patch 133 is attached by sewing to the flexible covering of the subframes 10, 30 and 50 at that location. Patch 133 also contains pockets or tubes 140, 141 and 142 into which the distal ends 14, 34 and 54 of struts 12, 32 and 52 are respectively inserted. Thus, patch 133 provides ventilation at the top of the tent where the flexible covering of the three adjacent subframes all come together and is part of the means for pivotally attaching the distal ends of vertical struts 12, 32 and 52. The patch also serves to attach the ends of those struts to the flexible covering.

As reinforcement and to facilitate attachment of the struts to the flexible covering, reinforcing patches 134, 135 and 136 are attached to the flexible tent covering at other areas where struts of adjacent subframes are joined. These patches also form the means for pivotally attaching those strut ends to one another. The patches reinforce the flexible covering, attach the struts to the flexible covering and form the pivotal connection between those struts. For example, patch 134 is sewn to the fabric at the point indicated in FIG. 7. The patch contains pocket 143 to receive distal end 20 of strut 18 on subframe 10 and pocket 144 to receive distal end 43 of strut 41 on subframe 30. Similarly, patch 135 contains pocket 145 to receive distal end 40 of strut 38 in subframe 30 and pocket 146 to receive distal end 63 of strut 61 in subfame 50. Finally, patch 136 contains pocket 147 to receive distal end 60 of strut 58 on subframe 50 and pocket 148 to receive distal end 23 of strut 21 of subframe 10.

Preferably patches 134, 135 and 136 are made of the same material as the flexible tent covering 3, but they could be made of other materials as well.

Finally, FIG. 7 illustrates that the distal ends 17, 37 and 57 of the vertical struts 15, 35 and 55, respectively, are attached to the tent covering 3 at their extremities as well. Since these struts contact the ground, the attaching means may include a sleeve sewn to the tent covering and having a rubber tip or point to provide a durable means for contacting the ground. Other means can be utilized known to one of ordinary skill in the art.

In a preferred embodiment of the present invention, the hubs 11, 31 and 51 are not attached directly to the fabric covering 3. The fabric covering is fixed to the subframe by attachment to the distal ends of the four struts in the subframe and extends over the hub. The hub itself does not extend through the fabric; only the straps, e.g., 120 with respect to hub 11, extends from the hub and though the covering to the outside. In the preferred embodiment, the straps 100, 110 and 120 extend sufficiently from the respective hubs to be staked to the ground and to serve as tie downs, as shown in FIGS. 1 through 3.

The tent of the present invention can collapse into a compact package shown generally in FIG. 10. In that condition, the three hubs lie next to one another at one end 150, and the twelve struts extend outwardly from the hubs generally parallel to one another with their distal ends at the other end 151 of the package. The length of the package is slightly more the length of an individual strut. The struts and hubs are overlayed by the fabric flexible covering 3. As illustrated in FIG. 10, the bundle can be wrapped with a belt 152 or other fastener so that it remains in a compact unit. The whole wrapped tent bundle can be carried in this manner or can be placed in a separate carrier or tote not shown.

To erect the tent, the buckle is released and the tent is unfolded on the ground. The user then erects each of the subframes one after the other in a process that takes but a few seconds. For example, the user can begin by erecting subframe 10 by pulling outward, i.e., to the exterior of the tent, on the hub 11 using strap 120. The hub passes over a center position in which all of the struts are in a single plane in relation to the hub to a position where the tension placed by the fabric on the four struts 12, 15, 18 and 21, holds the subframe in an erect, assembled condition. By doing this for each of the other two subframes in simple movements, the tent is easily erected. As shown in FIGS. 1 and 2, for example, the tension between the covering 3 and the struts in each of the subframes causes each of the struts in the subframe to bow outwardly and to exert an outward force on the hub, thereby maintaining it in position.

To "take down" or "strike" the tent, the user (from the outside of the tent) pushes or (from the inside of the tent) pulls inwardly on each hub to overcome the outward force presented by the bowed struts thereby releasing the tension on the hubs caused by the struts. After each subframe is collapsed, the subframes can be gathered together and secured as shown in FIG. 10.

The tent of the present invention maximizes important features particularly useful for overnight or longer term camping, or recreational or military uses. Among these is the fact that when collapsed, it forms a compact, lightweight and easy to manage bundle that can be easily transported. When it needs to be assembled, it can quickly be erected by a single person. Since the tent is of a unitary construction, nothing needs to be aligned, fitted or installed to form the complete tent.

The erected tent is extremely sturdy. Because it is comprised of three subframes, with struts running vertically to transmit forces on the flexible covering of the tent directly to the ground, it is quite stable under loads. An important feature of the present invention is that in the erected condition struts in each subframe are generally in a linear vertical condition directly applying any load to the ground, thereby improving load bearing capacity and avoiding any distortional forces that might cause collapse of the tent. The tent is also stable to lateral forces, treating forces from any direction in the same manner, thereby eliminating the need to align or realign the tent in a particular direction based on weather conditions or changes in those conditions. The tent is equally easy to take down.

Because the tent is of unitary construction there are no pieces that can be lost during erection, "taking down," storage or transportation of the tent. No pieces need to be located during the erection process. It is important to note that the unitary construction can be maintained even when the tent contains an integral floor (not shown). In that arrangement, the floor provides an outer covering for the entire tent when it is in the collapsed condition. Indeed, having an integral floor does not impair the operation of the tent during the erection or "striking" process. In addition, a floor attached to the distal ends 17, 37 and 57 in each of the subframes adds further stability to the tent when erected.

A further significant benefit of the tent is that its shape maximizes the internal space both in terms of ground area covered and volume of the interior. The shape also makes available improved ventilation. This is evident from the fact that there are three openings between the subframes that can be treated as windows, doors, sides or combinations thereof. The tent has a centrally located apex, that can be beneficially finished as a vent. The combination of three doorways or airways and the central vent provide a significant amount of ventilation with or without wind and regardless of the direction of any wind that may exist.

The drawings illustrate several of the preferred embodiments for providing entrance to the tent and ventilation.

As illustrated in FIGS. 2, 3, and 9 one of the ways of finishing the opening between adjacent subframes is to attach (e.g., by sewing, use of zippers) etc. material that can be used as a door. In FIG. 2, two triangular pieces of material 71 and 73 are employed. These pieces are sewn at their upper edges to the edges of the tent skin on two of the subframes. As shown in FIG. 2, snap fasteners 75 can secure the flaps or can be released (as shown in FIG. 9) to permit ingress or egress from the tent. Ties 76 are provided at the edges of the flexible covering 3 on each of the subframes, so that the mesh can be rolled up horizontally and tied for periods when the opening is to be used as an entrance or exit from the tent. The triangular pieces can be extended so that portions of them lie on the ground forming flaps that direct water away from the inside of the tent and any tent floor.

Figure 8:
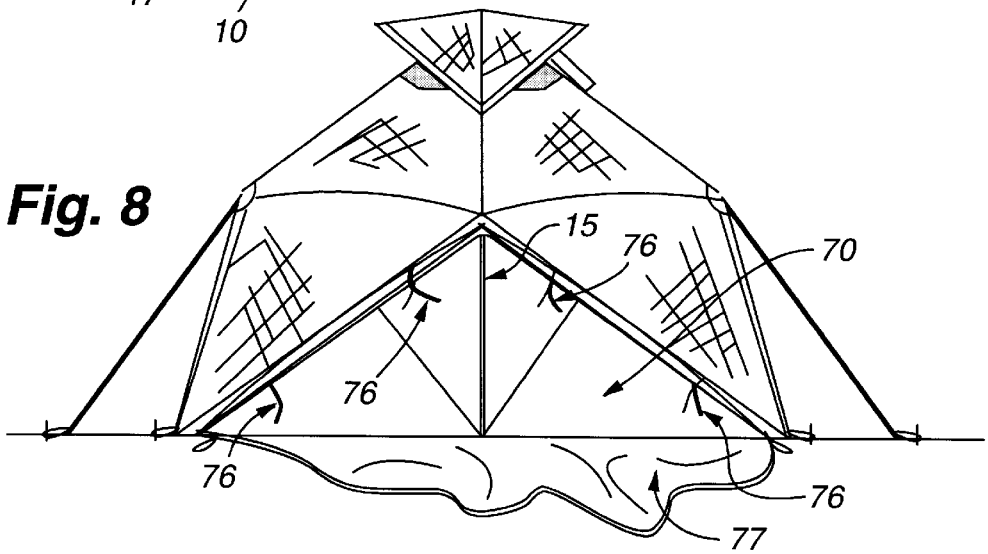
FIG. 8 is a detail view showing one form of covering that can be used at the opening between subframes of the tent.

In another embodiment illustrated in FIG. 8, the opening can be designed so that it cooperates with a triangular extension 77 from the floor of the tent. That triangular piece can extend along the ground, as shown in FIG. 8, when the door is open or can be folded up and attached by ties 76 to close the opening when desired.

Numerous other alternatives for treating these openings as doors or ventilation ports would be obvious to one of ordinary skill in the art. Indeed, for purposes of camping under certain, e.g., cold, conditions, it may be desirable that the tent covering be extended to cover them to provide additional warmth.

Figure 6A:
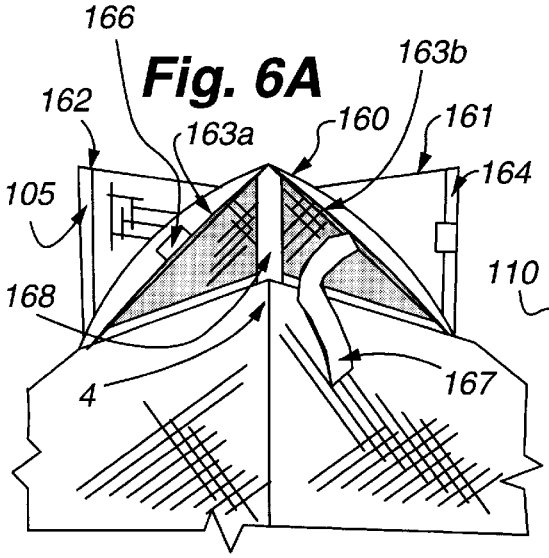
FIG. 6A is a detail view of the vent depicted in FIG. 3 in the open position.
Figure 6B:
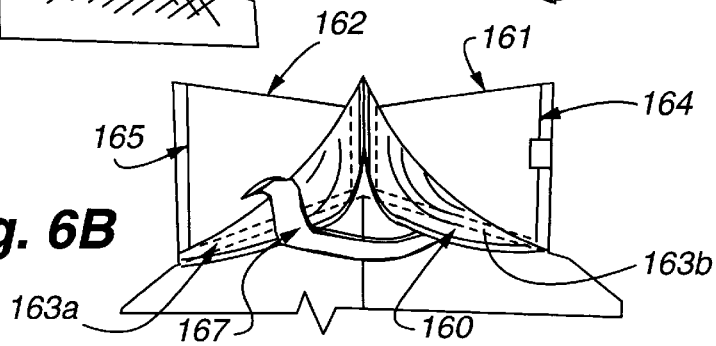
FIG. 6B is a detail view of the same vent in the closed position.

Finally, the tent of the present invention may have a centrally located ventilation means located at the apex of the tent. As mentioned previously, mesh patch 133 at the apex of the tent facilitates ventilation. Above patch 133 are a series of three connected canopies 160, 161 and 162 which provide openings for air movement while preventing precipitation from entering the tent through mesh patch 133. The canopy contains strap 168 which fastens the fabric covering 3 to the apex of the canopy. This connection is useful in orienting the canopy particularly during the process of taking down and folding the tent. The canopies each contain stiffeners, such as, 163*a* and 163*b* which support canopy 160. FIGS. 6A and 6B also show one of the stiffeners 164 and 165, each of which are part of the pair of stiffeners that support canopies 161 and 162, respectively. The stiffeners are sewn into the hem of the fabric forming the canopies and provide shape to keep the canopies open so that they do not collapse or tend to shut under load. The canopies are made of flexible water proof material and contain mating Velcro fasteners 166 and 167 so that one or more of the canopies can be securely closed if local weather conditions warrant. An open canopy is illustrated in FIGS. 3 and 6A. The same canopy is shown in the closed position in FIG. 6B. In the embodiment shown in the drawings, the fasteners 163*a* and 163*b* are sufficiently flexible so that they can accommodate the folding and secure closing of canopy 160. Alternatively, the fasteners can be made of a stiff, unbending material which are permitted to pivot or slide with respect to the tent covering 3 to accommodate closing of the canopy.

Other methods of providing ventilation ports at the apex of the tent could be provided by one of ordinary skill in the art.

The fact that the tent has an apex presents an opportunity for using a rain "fly" to provide maximum comfort and protection from the elements. In such a construction, tent skin 3 can be made entirely or partially of a mesh material and an additional water repellant layer can be draped over the mesh from the apex 4 to the ground. Moisture generated from people inside the tent can escape through the mesh. At the same time, the people inside will be protected from the elements as well as from annoying moisture collecting and dripping on the inside of the outer covering.

As can be seen, tents of the present invention are particularly useful for recreational or military camping purposes. This is particularly true for tents having subframes four to five feet in length along each side. On the other hand, tents can be constructed in sizes that are significantly larger making them useful for industrial or hospitality applications where it is desirable to enable one or more people to stand within the tent. However, when larger sizes, for example a tent with subframes 10 ft on a side, are employed, the assistance of an additional person may be helpful in erecting or "taking down" the tent. An additional attribute, is that tents of the present invention can be linked together at the openings between subframes in various configurations to form structures having multiple rooms. Means can be provided, such as straps with Velcro fasteners, zippers, etc. to secure the openings of adjacent tents to one another for this purpose.

The invention has been described in detail with reference to particular embodiments thereof, but it will be understood that various other modifications can be effected within the spirit and scope of this invention. For example, the description herein has shown a preference for subassemblies with struts of equal length. But it is possible to build tents of the present invention with struts of different lengths in the horizontal and vertical dimensions. Use of subframes with struts of equal length facilitates erection and taking down of each subframe and provides maximum structural stability without distortion.

I claim:

1. A lightweight, spacious and collapsible tent having an apex and contacting the ground on three struts, comprising:

three connected subframes each of said subframes containing four struts pivotally connected at one end to a central hub and extending radially outward to a distal end and a flexible covering having four sides and corners, said covering overlaying the hub and struts and extending so that each corner extend to the distal end of a strut;

each of said subframes being connected along two sides to one of the sides of each of the other two subframes;

each of said subframes having a strut the distal end of which is pivotally connected to the distal end of a strut from each of the other two subframes to form the apex of the tent; and each of said subframes resting on the ground on the distal end of a strut farthest from the apex.

2. The tent of claim 1 in which the strut whose distal end touches the ground in each subframe and the strut whose distal end forms the apex in the same subrame lie in a plane generally perpendicular to the ground.

3. The tent of claim 1 in which the subframes can be collapsed to form an easily transportable bundle in which the struts of all subframes are arranged in a generally parallel direction to one another.

4. The tent of claim 3 which also includes a flexible floor.

5. The tent of claim 4 in which the floor constitutes an outer covering for the tent bundle when in the collapsed condition.

6. The tent of claim 1 in which the flexible covering comprises a weather resistent, resiliently stretchable fabric.

7. The tent of claim 1 in which the flexible covering comprises polyester with a urethane coating.

8. The tent of claim 1 in which there is an opening for egress or ventilation between each pair of adjacent subframes and the ground.

9. The tent of claim 8 in which one or more of the openings between adjacent subframes and the ground is covered by a member selected from the group consisting of: (a) a mesh covering permitting ventilation; (b) partable covering temporarily permitting ingress or egress and (c) a covering baring ingress or egress.

10. The tent of claim 8 in which at least one of the openings between adjacent subframes and the ground contains means for securing that opening in interconnected relationship with a similar opening on another tent.

11. The tent of claim 1 in which the hub of each subframe is not directly attached to the fabric covering.

12. The tent of claim 1 in which the hub of at least one subframe has means extending through the fabric covering which means may be attached to the ground to secure the tent.

13. The tent of claim 1 which further contains a flexible rain fly extending from the apex of the tent and covering at least a portion of the fabric covering.

14. The tent of claim 13 wherein at least a portion of the flexible covering underlying the rain fly is made of mesh or other permeable material permitting ventilation from the interior of the tent underlying the flexible covering.

15. The tent of claim 1 wherein a portion of the flexible covering in at least one subframe adjacent the apex is made of mesh or other permeable material permitting ventilation.

16. The tent of claim 15 wherein the portion of the flexible covering made of mesh or other permeable material is protected from environmental conditions by a canopy.

17. The tent of claim 16 wherein the canopy comprises stiffening means to maintain the location of the canopy.

* * * * *